United States Patent [19]

Easton

[11] Patent Number: 4,928,363

[45] Date of Patent: May 29, 1990

[54] ZIPPER SECURING RING

[76] Inventor: Wayne Easton, R.R. 1, Box 156H, East Carondelet, Ill. 62240

[21] Appl. No.: 371,318

[22] Filed: Jun. 26, 1989

[51] Int. Cl.[5] ..... A44B 19/26

[52] U.S. Cl. ..... 24/390; 24/370; 24/429

[58] Field of Search ..... 24/390, 387, 370, 429, 24/3 H; 294/3.6

[56] References Cited

U.S. PATENT DOCUMENTS

| | | | |
|---|---|---|---|
| 652,905 | 7/1900 | Swales | 24/370 |
| 1,671,539 | 5/1928 | McLimans . | |
| 2,018,948 | 10/1935 | Corner | 24/429 |
| 2,111,924 | 3/1938 | Etten | 24/387 |
| 2,223,347 | 12/1940 | Axthelm | 24/205 |
| 2,579,276 | 12/1951 | Schworm | 24/387 |
| 2,656,579 | 10/1953 | Wilson | 24/387 |
| 2,663,588 | 12/1953 | Scheldorfer | 294/3.6 |
| 2,675,559 | 4/1954 | Miller | 2/234 |
| 3,145,041 | 8/1964 | Grolig | 294/3.6 |
| 3,255,503 | 6/1966 | Sozzi | 24/205 |
| 3,271,832 | 9/1965 | Yankers | 24/205 |
| 3,325,869 | 6/1965 | Younger | 24/205 |
| 3,641,634 | 2/1972 | Asai | 24/429 |
| 4,790,156 | 12/1988 | Yang | 24/387 |

*Primary Examiner*—Victor N. Sakran
*Attorney, Agent, or Firm*—Andsel Group

[57] ABSTRACT

A removable metal tab having the top portion configured to enclose a securing button on the front waist band of mens jeans, or trousers. The lower portion of the tab being removably fastened to the orifice in the top of the slide fastener of the zippered fly opening thus preventing the involuntary opening of the fly by a sliding zipper fastener.

1 Claim, 1 Drawing Sheet

ZIPPER SECURING RING

BACKGROUND OF THE INVENTION

1. Field of the Invention

Slide fastener devices are common, employed to accomplish quick and efficient closures on men and womens jackets, jeans and the like. When used on jeans, particularly, the fly on mens jeans, they occasionally slide downwardly to open the closure. Various means have been designed to lock the zipper in the upper or closed position.

2. Description of the Prior Art

Many of the slide fastener attachments disclosed in the prior art employ an accessory attachment to the top of the slide fastener moving element. U.S. Pat. No. 2,111,924 discloses a locking device including a first snap-fastener matching a second snap fastener attached to the waistband of a pair of mens trousers, U.S. Pat. No. 2,675,559 discloses a similar device comprising a two opening latch attached to the slider of a slide fastener. U.S. Pat. No. 2,579,276 discloses a section of flexible tape with an opening for attaching to a button, or the like, fastened to the slider of a slide fastener. Several somewhat similar devices are disclosed in the referenced prior art listed in this patent application.

SUMMARY OF THE INVENTION

The instant invention comprises a flat, ring shaped, strip of metal having a clip on the lower portion adapted to removably fasten the ring to the top of a slide fastener. The inside diameter of the ring configured to accept a button or snap fastener on the front waist line of a pair of mens jeans, or trousers. The button, or snap fasteners are common to mens jeans, or trousers, as a means for closing the waist line, belt portion, of the jeans, or trousers.

DETAILED DESCRIPTION OF THE PREFERRED EMBODIMENTS

Figure 1:
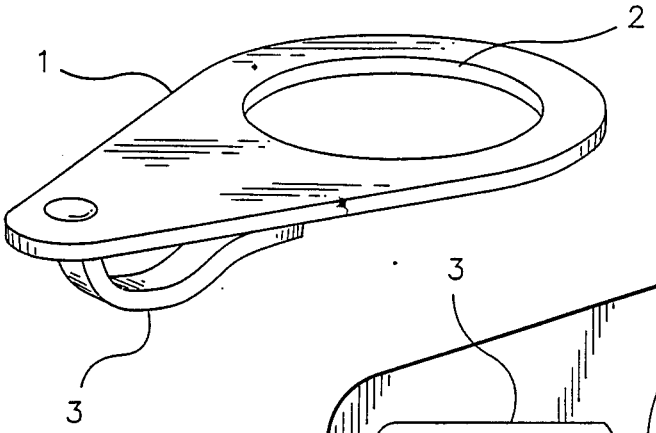
FIG. 1 is top perspective view of the fastening ring.
Figure 2:
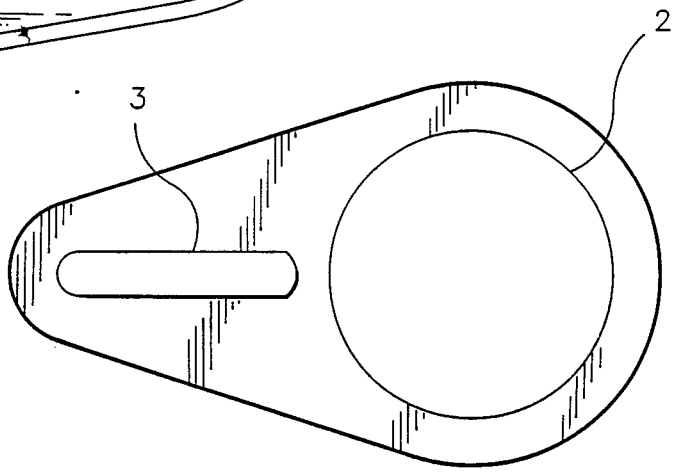
FIG. 2 is a plan view of the fastening ring.
Figure 3:
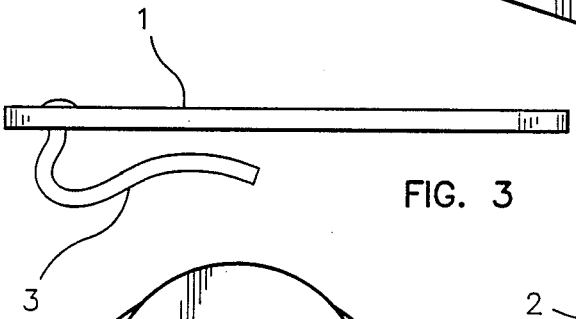
FIG. 3 is a slide view of the fastening ring.
Figure 4:
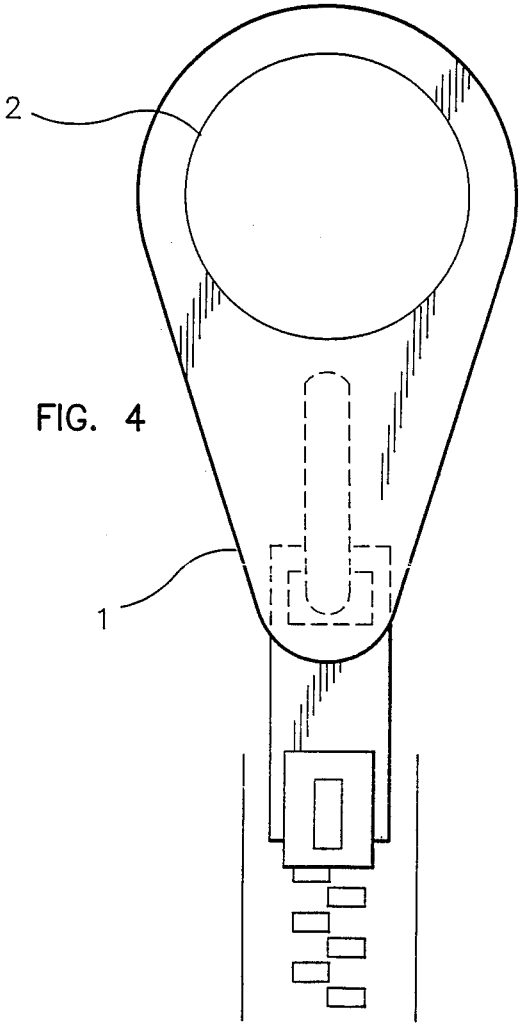
FIG. 4 shows the fastening ring, attached to the slide portion of zipper.
Figure 5:
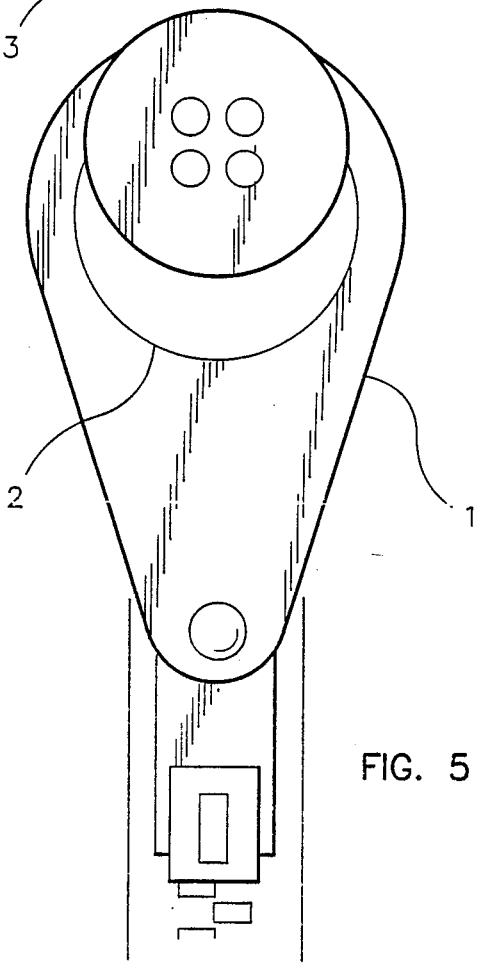
FIG. 5 shows the fastening ring attached to a button on the waist band of the jeans.

Referring to FIG. 1 the flat plate 1 is shown with button orifice 2 and zipper engagement hook 3. Flat plate rounded on one end to clear the outside diameter of the button orifice then tapering down to a width just sufficient to accommodate mounting the engagement hook 3.

In use the hook 3 is fastened to the opening in the top of the slide fastener or zipper. The slide fastener is then raised to close the fly and the zipper securing ring is placed over the jean, or trouser fastening button prohibiting the slide fastener from sliding down and opening the fly.

I claim:

1. A fastening attachment secured to the top portion of a zipper slide to prevent inadvertent opening of the closure wherein the improvement comprises:

(a), a flat strip of metal having an orifice at one end;

(b), the strip of metal tapering down to a point at the other end;

(c), the diameter of the orifice sufficiently large to encircle the securing button on the waist band of a mans jeans, or trousers;

(d), a hook shaped clamp, extending normal to the surface of the flat strip, at the pointed end of the strip;

(e), the hook clamp having a width compatible with the orifice in the top of the slidable zipper fastener; and, (f), hook of the flat metal strip engaging the slidable zipper with the top orifice over a support button locks the zipper in the upward closed position.

* * * * *